United States Patent [19]

Mulvenna

[11] Patent Number: 4,540,344

[45] Date of Patent: Sep. 10, 1985

[54] ENERGY TRANSFER DEVICE

[76] Inventor: Charles A. Mulvenna, 129 Cairn Grove, Kingston, Ontario, Canada, K7M 4C1

[21] Appl. No.: 530,137

[22] Filed: Sep. 7, 1983

Related U.S. Application Data

[63] Continuation-in-part of Ser. No. 130,693, Mar. 17, 1980, abandoned.

[51] Int. Cl.[3] ..... F04F 7/00

[52] U.S. Cl. ..... 417/240

[58] Field of Search ..... 417/240, 241, 211, 478, 417/479, 480, 484, 481

[56] References Cited

U.S. PATENT DOCUMENTS 2,972,957 2/1961 Fisher ..... 417/241

3,617,153 11/1971 Mowry ..... 417/241

*Primary Examiner*—Richard E. Gluck

*Assistant Examiner*—Peter M. Cuomo

[57] ABSTRACT

An energy transfer device comprising a tube coiled in the form of an open helix and anchored permitting bending of the tube about the axis of the helix. The tube is bent by being oscillated about the axis of the helix alternately increasing and decreasing the diameter of the helix resulting in a progressive change in axial tube velocity. This effectively squeezes and releases the fluid in the conduit causing the fluid to flow. Unidirectional flow is obtained by locating two one-way flow control valves in the flow path at respective ones of first and second positions spaced apart from one another and having the oscillated portion of the tube located between such valves. The amount of energy transferred is increased substantially when the system is tuned and this is accomplished by having the tube of selected length between the two flow control valves co-related to the fluid wave propagated along the tube with the velocity of sound in the fluid relative to the fluid. The squeezing or pressure increase in the fluid is transmitted along the fluid column at sound velocity until it is reflected by a restriction. The pressure increase then moves back along the fluid column past its starting point until it is again reflected by another restriction and when the system is perfectly tuned the wave arrives back at the starting point exactly one revolution later to be squeezed again.

18 Claims, 11 Drawing Figures

TUBE PUMP
ZERO FLOW OUTLET PRESSURE
SPEED CHARACTERISTIC
THEORETICAL
EXPERIMENTAL
OUTLET PRESSURE P.S.I.
300
200
100
0
200
300
400
500
600
700
800
SPEED CYCLES/MIN.

ENERGY TRANSFER DEVICE

This is a continuation-in-part of application Ser. No. 130,693 filed Mar. 17, 1980.

This invention relates to a device for transferring energy to or from a fluid in which a fluid flows through a movable tube. The invention will be described particularly with reference to pumping a fluid through a tube coiled into the form of an open helix, by alternately increasing and decreasing the diameter of the helix and, as will become more apparent hereinafter, the invention is not limited to such particular application.

In the prior art there are a number of proposals based on the principle that energy can be transferred to a fluid in a tube by moving the tube. For further details on such apparatus, reference may be had to U.S. Pat. Nos. 2,948,225 issued Aug. 2, 1960, 2,936,713 issued May 17, 1960, 2,918,875 issued Dec. 29, 1959, 3,077,162 issued Feb. 12, 1963, 3,617,153 issued Nov. 2, 1971, 3,241,826 issued Mar. 22, 1966 and British Pat. No. 130,332 accepted July 29, 1920.

The above patented devices include a length of tube variously formed to provide a fluid flow path and at least part of the tube is moved to cause a pumping action. Check valves are employed to provide unidirectional flow. While such apparatuses are operative, they are considered impracticable due to poor efficiency. The volume of fluid pumped and/or pressures obtainable are very low unless, for example, as disclosed in Fischer's U.S. Pat. No. 2,948,225 a propellent fluid such as mercury or the like relatively heavy liquid is used. Even then as disclosed in such patent, a three-phase system is required to build up a pressure of 2,000 psi in the external circuit. It is believed the patentees failed to understand why results were obtained and thus unable to provide an appropriate design for efficient and effective operation.

A principal object of the present invention is to provide improvements in the foregoing general type of apparatus to improve the efficiency of the same.

The present applicant, through years of research and experimentation, has gained considerable understanding and knowledge concerning operability of such energy transfer devices. Applicant has found there are two major considerations for obtaining optimum results, one being how the pipe or tube is moved and the other involves tuning the system. From this the present applicant has developed an apparatus which, from laboratory tests, produces results heretofore unobtainable. The apparatus of the present invention is essentially a tube of selected length having at least a portion thereof coiled into the form of an open helix and anchored permitting bending of the tube of the helical portion about the axis of the helix. To effect pumping, the tube is bent alternately in one direction and then the other. The bending effectively changes the radius of curvature of tube, resulting in a progressive change in axial tube velocity. Such movement applicant has found to be necessary for good results as he has discovered that in order to generate a wave in a conduit, the fluid velocity with respect to the adjacent conduit must vary along the length of the conduit. Tuning the system involves having the length of free flow path through the tubing; i.e., between two spaced apart one-way flow control valves, co-related to the fluid wave that is generated by bending the tube and propagated along the tube with the velocity of sound in fluid relative to the fluid.

The tube as referred to herein is intended to mean one which is sufficiently rigid as to be dimensionally stable radially and substantially unaffected by changes in fluid pressure in the tube while at the same time having flexibility to permit bending alternately in one direction and the other so as to increase and decrease the radius of curvature of the coiled tube. Essentially, the energy transfer device is a tube in the form of a torsion spring suitably anchored to permit alternately winding up and unwinding the spring. Winding the spring tighter squeezes the contained fluid and unwinding releases it. During winding of the tube there is a progressive change in velocity of the tube axially along its length. The operation and tuning can briefly be explained as follows. If one considers the fluid at a particular point in the tube and squeezed at that point by bending the tube, the same volume of fluid tries to occupy less space. This squeeze or pressure increase is transmitted along the fluid column (at sound velocity) until it is reflected by a restriction. The pressure increase then moves back along the fluid column past its starting point until it is again reflected by another restriction. If it arrives back at the starting point exactly one revolution later to be squeezed again the system is perfectly tuned.

The basis for tuning perhaps may be explained by considering water hammer. Water hammer effect is evident when a valve in a long pipe line is closed decelerating the moving column of fluid. The pressure at the valve increases and this pressure increase is propagated upstream from the valve with the velocity of sound in the fluid column. The kinetic energy of the fluid is converted to strain energy; i.e. pressure. Water hammer is often accompanied by vibration of the pipe and a hammering noise. The effect is utilized in the present invention and provides a means of storing the energy in the field, a means of increasing the maximum pressures and a means of increasing the energy flow to the fluid. Outstanding results occur when the fluid is squeezed externally at the same time as the pressure is built up internally; i.e. like closing the valve and immediately forcing it upstream.

Applicant has developed what may be referred to as the tube pump and which will be explained in detail hereinafter. The theory has been proven by actual tests and provides a basis for a complete and thorough understanding of the present invention. From the description and theory to follow it will be evident applicant's invention broadly is an energy transfer device comprising (a) a supporting structure; (b) a rigid tube of selected length adapted for connection in fluid flow communication with an external fluid system and having respectively first and second opposite ends, at least a portion of said selected length of tube being coiled into the form of an open helix; (c) means retaining said helical portion essentially in a fixed position relative to the supporting structure; (d) means fixedly anchoring the helical portion of the tube at a first position thereon to the supporting structure, said helical portion at a second position spaced from said first position axially along the tube being movable in an arc about the axis of the helix; and (e) means to move said helical portion at said second position in an arc about the helix alternately to increase and decrease the radius of curvature of the helical portion between said first and second positions whereby there results a progressive change in axial tube velocity along the helical portion of the tube from one to the other of said first and second positions.

The invention and various embodiments thereof are illustrated by way of example with reference to the accompanying drawings wherein:

FIG. 11 is a graph illustrating incremental distance vs. time.

Figure 1:
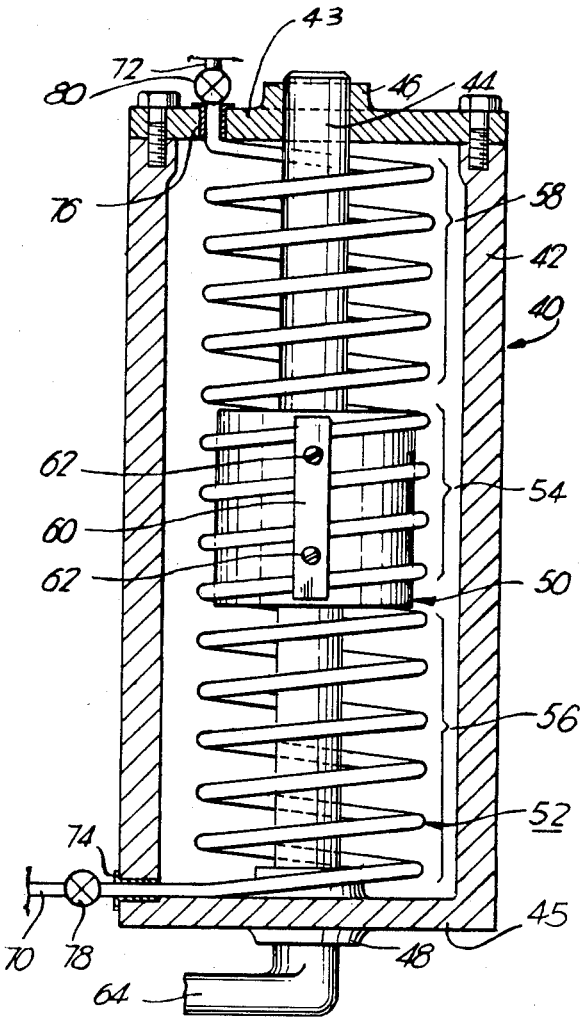
FIG. 1 is a partial sectional, elevational view of one device provided in accordance with the present invention.

Referring to the drawings, FIG. 1 illustrates a fluid energy transfer device 40 used as a pump but as will become apparent hereinafter may be used as a fluid motor. The energy transfer device 40 includes a supporting structure 42, a shaft 44 journalled for rotation in spaced apart walls 43 and 45 of the supporting structure by respective bearings 46 and 48 and a conduit 52 wound in the form of an open helix. The shaft is formed with an enlarged portion 50 (or alternatively has a drum attached to the shaft providing the enlarged portion) to which a portion 54 of the conduit 52 is secured by, for example, being nested in a helical groove in the outer surface of the drum or by means of a clamping bar 60 which overlies one or more helices of the conduit and is anchored to the drum by screws 62.

The helically wound coil has further free end portions designated respectively 56 and 58 surrounding the shaft and are fixedly secured to the support structure 40 at resectively 74 and 76. The coiled conduit portions 54, 56 and 58 are contiguous with one another, i.e. in series, providing a fluid flow path from one end to the other of respective opposite ends 70 and 72 of the conduit. To pump a fluid through the conduit shaft 44 is oscillated about its axis by any suitable power means. For example, crank arm 64 on the end of the shaft can be driven by a motor via suitable connecting linkages. Oscillation of the shaft effectively causes each of the coiled conduit portions 56 and 58 to increase in diameter (that is, the diameter of the helix) when moved in one direction and decrease in diameter when moved in the other direction. The coiled portions 56 and 58 effectively form the active portions for pumping the fluid through the conduit and the portion 54 is a passive section utilized, as will be seen hereafter, for tuning the system to maximize flow and/or pressure. To utilize the fluid flow energy transfer device of FIG. 1 as a pump, one or more flow restrictors are connected to or associated with the flow path through the conduit. In FIG. 1, such flow restrictors are respective unidirectional or one way flow valves 78 and 80 permitting flow of fluid from the inlet end 70 to the outlet end 72.

Figure 4:
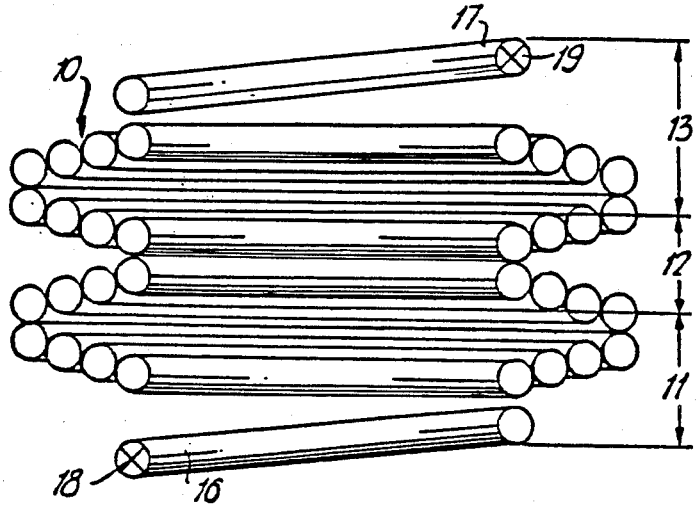
FIG. 4 is an elevational view of an alternative arrangement for the helically coiled conduit.

Using water as the operating fluid the device illustrated will theoretically generate a pressure of at least 20,000 psi when oscillating the shaft 44 approximately 4° at 30 cycles per second for a selected length of tube. The rate of oscillating the tube varies with the length of the tube and generally the longer the tube the lower the speed at which maximum pressure occurs. While two pressure generating coil portions 56 and 58 have been illustrated, only one is required or more than two may also be utilized. The helically coiled portions illustrated in FIG. 1 are cyclindrical and if desired, they may be conical or multi-conical, for example as illustrated in FIG. 4. The helically coiled portions 56 and 58 are free to elastically deform to provide the desired deflection for the required output, such deflection taking place in the length of tubing between first and second spaced apart positions on the tube one position being where it is fixed to the supporting structure and the other position being where it is attached to the drum or shaft enlarged portion 50. The length of each of the tube portions 56 and 58 between the first and second positions may only be as long as is required to provide the desired deflection (which is dependent upon the required output) while keeping the tube material stress within the fatigue limit. This length should preferably, however, be no longer than one-quarter of the enclosed fluid wavelength.

In operation, as a pump inlet conduit 70 is connected to a source of fluid and the conduit filled with the fluid, crank arm 64 is driven by suitable means to oscillate the shaft a small amount, i.e., in the range of 3.5° to 4° and the oscillations are transmitted to the coil sections 56 and 58, alternately winding and unwinding the same. The alternately increasing and decreasing diameter of the coil sections 56 and 58 generate a pressure in the fluid in the conduit and a unidirectional flow pumping results from the use of one way flow control valves 78 and 80. With one end or portion of the helically coiled tube being held fixed and the other forced to move in a direction about the axis of the helix, the radius of curvature of the helix is forced to change. This, as previously indicated, provides the requisite tube movement, i.e., progressive increase in the tube velocity from one position on the tube to another position spaced therefrom axially along the tube. This is now more fully explained with with reference to FIG. 7.

Figure 7:
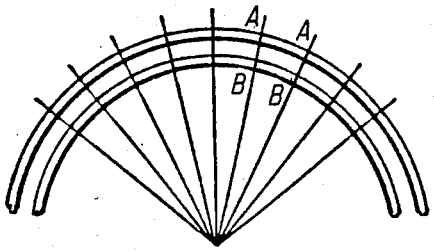
FIG. 7 is a top plan, partial view illustrating on an exaggerated scale, the unstrained and minimum radii of curvature of the helical coil when oscillated about its axis and having the ends of the conduit fixed.

FIG. 7 is a top plan view of a section of the helical tube illustrated in two different positions, one being the unstrained initial position and the same section in a more tightly coiled position. A fluid in the conduit that initially occupies the length of the tube A—A in the initial position of the tube is forced to try to occupy the length B—B in the final position of the tube. Since B—B is shorter than A—A, the column of fluid is squeezed, i.e. pressure is applied to the fluid. This effect is described mathematically, for design purposes, by the change of axial velocity of the tube along the tube length. For maximum energy transfer across the tube and maximum efficiency, the tube velocity must progressively increase and this progressive increase in velocity occurs in applicant's device between a position at which the helically wound tube is fixedly held relative to the frame and another position spaced therefrom axially along the tube which is moved. This is achieved by moving the tube about the axis of the helix while the axis of the helix remains essentially stationary. No energy is transferred across the tube wall where there is no change in tube velocity along the tube length.

Considering the well known water hammer effect, fluid pressure or strain energy is converted to fluid velocity or kinetic energy when the fluid is permitted to accelerate. A fluid wave resulting from the pressure generated by the squeeze effect described above is propagated along the tube with the velocity of sound in the fluid relative to the fluid.

In order to maximize fluid flow and/or pressures generated, tuning of the fluid wave is required. This is determined by the length of tube between the check valves and preferably is equal to one-half the length of the enclosed wave (or some integral number thereof). This half wavelength tuning provides the shortest practical length for a pump or impact device application and, depending upon the required output, increases pressure and/or fluid flow by a factor of 100 or more compared to an untuned device. In some applications the length of tube between the one way fluid flow devices may be an integral number of half wavelengths or the tube may form a closed loop which has a length equal to an integral number of times the half wavelength. Where it is desired to generate pressure of a few hundred pounds per square inch, the tube length may be up to 25 percent greater or less than the half wavelength. The length of the tube between the one way flow restrictor, i.e. 78 and 80 or half wavelength are calculated from the following formula: $L=A/2n$ where L equals the tube length (half wavelength) in feet; A equals velocity of sound in the fluid in feet per second and n equals the number of tube oscillations in cycles per second The length L of a typical steel tube for pumping water oscillated at 30 cycles per second is 70 feet.

In the foregoing reference has been made to one way flow control valves. Effectively these are restrictions to fluid flow at two spaced apart positions in the flow path and which flow path has the helically coiled portion of the tube therein. The restrictions need not be one way valves but may instead be diodes, pistons or closed or partially closed portions of the tube.

Figure 2:
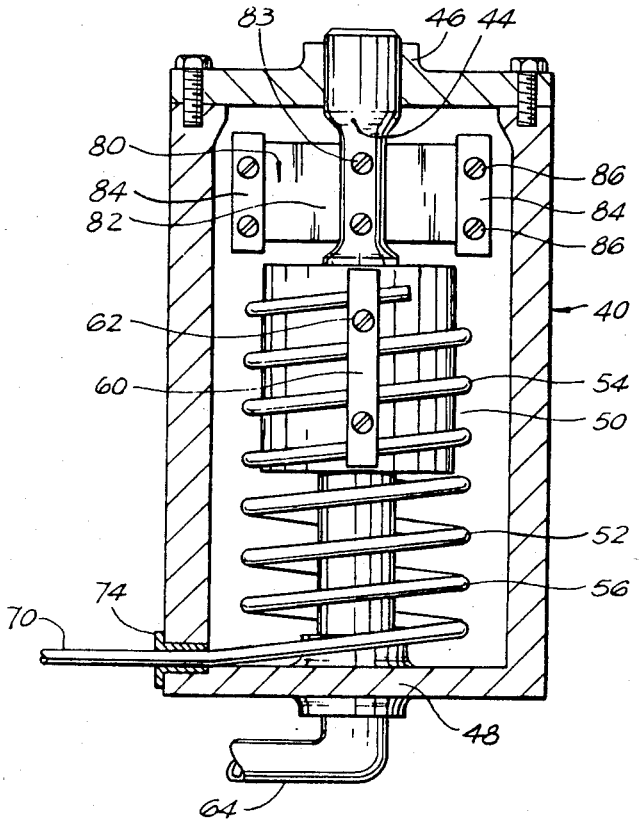
FIG. 2 is similar to FIG. 1 but illustrating modifications.
Figure 3:
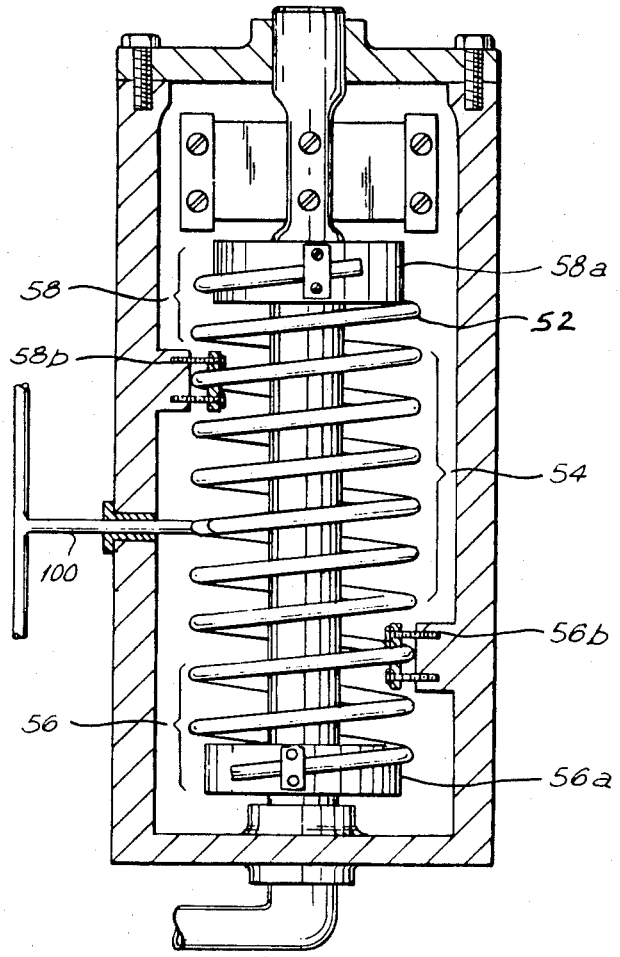
FIG. 3 is similar to FIGS. 1 and 2 but illustrating still further modifications.

Numerous variations of the previously described apparatus are possible, some of which are illustrated in FIGS. 2 and 3. In the embodiment illustrated in FIG. 2, there is only one active coil section and also there is included a spring mass system. As far as the active coil portions are concerned there can be any number and the only requirement is that each active coil portion have a fixed end and a movable end, with the tube between such ends being coiled about an axis permitting bending of the coil about such axis.

Referring to FIG. 2, wherein the same reference numerals have been used to designate the same parts described with reference to FIG. 1, there is one active coil portion 56 and a passive (or tuning) coil portion 54. The conduit 52 is fixed at end 74 and adapted for connection at that end to an external circuit. The other end may be either closed or connected in fluid flow communication with an external circuit. When closed the device of FIG. 2 may be used to drive an impact tool illustrated in FIG. 5 or 6 and which will be described hereinafter.

The spring mass system is designated generally by the reference numeral 80 and consists of a spring plate 82 secured to the shaft and projecting radially therefrom. For purposes of ease in balancing to avoid vibration, spring plate 82 passes through a slot in the shaft and is secured in any convenient manner, for example, by set screws 83. Obviously, other mounting arrangements may be used and still provide a balanced system. Weights or masses 84 are secured to the outer free ends of the spring plate 82 by screws 86 (or other suitable securing means).

The natural frequency of oscillation of the spring mass system 80 is arranged to be below the driving frequency of the shaft 44 so that at the driven frequency the spring-mass system will oscillate approximately 180 degrees out-of-phase from the drum-shaft-conduit system in a manner well known to those skilled in such field. The inertia force required to oscillate the shaft-drum-conduit system is then provided by the inertia force of the spring-mass system. The force required to transmit the energy to the fluid is transmitted by crank arm 64.

The outer turns of the helical conduit adjacent to the fixed section 74 (and 76 in FIG. 1) should be designed with sufficient flexibility that only a small proportion of the inertia force is transmitted to the machine frame. To facilitate this, the outer turns may be wound in a conical helix and arranged so that the largest diameter turn is adjacent to the fixed portions 74 (or 76 in FIG. 1).

Figure 5:
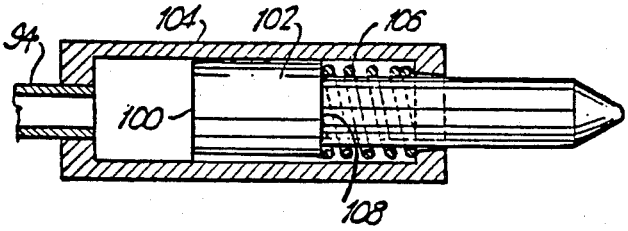
FIGS. 5 and 6 are partial sectional views of impact units for use in association with the devices of FIGS. 1, 2 & 3.

The device of FIG. 2 may be used to drive the impact device shown in FIG. 5. The impact device consists of a body 104 having a piston 102 slideably mounted therein and biased in one direction (to the left as viewed in FIG. 5) by a spring 106. Integral with the piston is an impact tool 108 that projects through an opening in the end of the body. The opposite end of the body has a conduit 94 communicating with the interior of the body and is adapted to be connected to the fluid output side (end 70) of the device illustrated in FIG. 2. In operation, fluid pressure transmitted to the impact device from the device 40 through the conduit 94 acts on the face 100 of the piston producing a force that is transmitted to the impact tool 108.

The impact tool is driven by the device shown in FIG. 2 in the following manner. The end 70 of the helical conduit 52 of the device shown in FIG. 2 is connected to the conduit 94 of the impact device shown in FIG. 5 by a length of conduit such that the length of the fluid column enclosed between the face 100 of the piston of the impact device and the oscillated closed end of the conduit 52 is equal to one half of the length of the enclosed fluid wave. This length may be calculated in the manner previously described. A forced oscillation of the crank arm 64 oscillates the coil portion 54 of the conduit 52, deforming the coils 56 and generating a pressure that is propagated along the conduit to act on the face 100 of the piston 102 of the impact device. This pressure results in a force on the piston that is transmitted to the impact tool 108.

Figure 6:
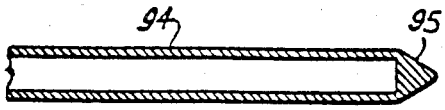

Alternatively, the impact device may be as shown in FIG. 6 which is nothing more than conduit 94 closed at one end by a work engaging tip 95.

In the device illustrated in FIG. 3, the active coil portions 56 and 58 are oscillated by having respective opposite ends of the tube 52 connected to the shaft by respective drums 56A and 58A. The passive or tuning coil portion 54 is stationary as a result of tube 52 being anchored to the supporting structure by respective clamps 56B and 58B. Coil portion 54 is adapted for connection in fluid communication with an external circuit by conduit 100.

It should be noted that all the devices previously described will operate on any fluid, e.g., gas, liquid, slurry, but where a liquid containing gas is used the axis of the helical tube should be vertical to permit gas that separates from the liquid to rise up the conduit and escape from the top.

It will also be understood that although half wavelength tuning, previously explained, provides for maximum output, in some cases, particularly where a number of devices are combined in the same circuit, tuning may be achieved by having the length of the enclosed fluid column equal to an integral number of times the half wavelength.

It will also be noted that where it is desired to use a conduit that is not sufficiently rigid to support its own weight over the unsupported pressure generating section of the helix then such a conduit may be clamped to a mechanical helical spring for support.

Applicant, as previously mentioned, has developed a tube pump theory which will be explained as follows. Taking $v_F$=the absolute fluid velocity
$v_T$=the absolute tube velocity
$v_R$=the velocity of the fluid relative to the tube
x=length of tube in inches measured along the tube

Continuity Equation

Consider an element of tube having a length of $\delta\times$mass flow into element$=\rho A(v_F-v_T)$
where
$\rho$=fluid density and A=tube cross-sectional area
mass flow out of element=

$$\rho A(v_F - v_T) + \frac{\partial}{\partial x}[\rho A(v_F - v_T)]\delta x$$

net mass flow into element=

$$-\frac{\partial}{\partial x}[\rho A(v_F - v_T)]\,\delta x$$

This is equal to the rate of change of mass in the element with time. i.e., $$-\frac{\partial}{\partial x}[\rho A(v_F - v_T)]\,\delta x = \frac{\partial}{\partial t}(\rho A\delta x) \qquad \text{(II)}$$

$\delta x$ is independent of time, i.e., the tube length does not change, then, $$-\frac{\partial}{\partial x}[\rho A(v_F - v_T)] = \frac{\partial}{\partial t}(\rho A) \qquad (1)$$

or $$-\frac{\partial}{\partial x}(\rho A\, v_R) = \frac{\partial}{\partial t}(\rho A)$$

using the fact that $$\frac{\partial \rho}{\partial x} << \frac{\partial \rho}{\partial t}$$

and $$\frac{\partial A}{\partial x} << \frac{\partial A}{\partial t}$$

also $$\frac{1}{A}\frac{\partial A}{\partial t} = \frac{D}{Et}\frac{\partial P}{\partial t}$$

where
D is tube diameter, E is Young's Modulus for tube material, t is the tube wall thickness and
P is fluid pressure.

$$\frac{1}{\rho}\frac{\partial \rho}{\partial t} = \frac{1}{K}\frac{\partial p}{\partial t}$$

and $$a^2 = \frac{(K/\rho)}{1 + \frac{KD}{Et}}$$

where
K is the fluid bulk modulus
a is the velocity of sound in the fluid contained in the tube having parameters D,E,t.
equation (1) reduces to:

$$\frac{\partial v_R}{\partial x} + \frac{g}{a^2}\frac{\partial H}{\partial t} = 0 \qquad (2)$$

where
g is the gravitational constant
H is the fluid pressure in feet.

[the equivalent equation (well known) for a stationary tube is $\frac{\partial v_F}{\partial x} + \frac{g}{a^2}\frac{\partial H}{\partial t} = 0$]

Equation of motion

The equation of motion for the case of a moving tube is the same as the well known equation for a stationary tube, i.e., $$g\frac{\partial H}{\partial x} + \frac{\partial v_F}{\partial t} = 0 \qquad (3)$$

Writing $v_R$ in equation 2 as $v_F-v_T$, multiplying equation 2 by $\lambda$ and adding to equation 3 gives, $$\left(\lambda\frac{\partial v_F}{\partial x} + \frac{\partial v_F}{\partial t}\right) + \frac{g\lambda}{a^2}\left(\frac{a^2}{\lambda}\frac{\partial H}{\partial x} + \frac{\partial H}{\partial t}\right) = \lambda\frac{\partial v_T}{\partial x}.$$

by putting $$\lambda = \frac{a^2}{\lambda} = \frac{dx}{dt}$$

the partial derivatives on the left hand side of this equation may be converted to total derivatives. i.e., $$\frac{dv_F}{dt} + \frac{g\lambda}{a^2}\frac{dH}{dt} = \lambda\frac{\partial v_T}{\partial x} \qquad (4)$$

where $\lambda=\pm a$
for $\lambda=+a$ equation 4 becomes $$\frac{dv_F}{dt} + \frac{g}{a}\frac{dH}{dt} = a\frac{\partial v_T}{\partial x} \qquad (5)$$

for $\lambda=-a$ equation 4 becomes $$\frac{dv_F}{dt} - \frac{g}{a}\frac{dH}{dt} = -a\frac{\partial v_T}{\partial x} \quad (6)$$

if conditions are known at time T then equation 5 and 6 may be used along the characteristics dx/dt=+a and dx/dt=−a respectively in order to calculate conditions at time T+δT (see FIG. 11).

The fluid velocity $V_P$ and fluid pressure $H_P$ at station P at time T+δT may be calculated by using the known fluid velocities and pressures at time T at stations A and B and solving the simultaneous equation 5 and 6 which apply between A and P, and B and P respectively. equation 5 applied between A and P gives, $$v_{FP} - v_{FA} + \frac{g}{a}(H_p - H_A) = a\frac{\partial v_T}{\partial x}\delta t \quad (7)$$

but $$\begin{aligned} v_{RP} - v_{RA} &= (v_{FP} - v_{TP}) - (v_{FA} - v_{TA}) \\ &= (v_{FP} - v_{FA}) - (v_{TP} - v_{TA}) \\ &= (v_{FP} - v_{FA}) - (v_{TP'} + \Delta v_T - v_{TA}) \end{aligned}$$

Where $\Delta v_T$ is the change in the tube velocity at distance x in time δt i.e., the change in tube velocity between P' and P rewriting, $$\begin{aligned} v_{RP} - v_{RA} &= (v_{FP} - v_{FA}) - ((v_{TP'} - v_{TA}) + \Delta v_T) \\ &= (v_{FP} - v_{FA}) - \left(\frac{\partial v_T}{\partial x}\delta x + \Delta v_T\right) \end{aligned}$$

Using a=δx/δt and substituting for $v_{FP}-v_{FA}$ in equation 7 gives $$v_{RP} - v_{RA} + \frac{g}{a}(H_p - H_A) = -\Delta v_T \quad (8)$$

equation 6 applied between P and B gives, $$v_{FP} - v_{FB} - \frac{g}{a}(H_P - H_B) = -a\frac{\partial v_T}{\partial x}dt \quad (9)$$

but $$\begin{aligned} v_{RP} - v_{RB} &= (v_{FP} - v_{TP}) - (v_{FB} - v_{TB}) \\ &= (v_{FP} - v_{FB}) - (v_{TP} - v_{TB}) \\ &= (v_{TP} - v_{FB}) - (v_{TP'} + \Delta v_T - v_{TB}) \\ &= (v_{FP} - v_{FB}) - ((v_{TP'} - v_{TB}) + \Delta v_T) \\ &= (v_{FP} - v_{FB}) - \left(\Delta v_T - \frac{\partial v_T}{\partial x}\delta x\right). \end{aligned}$$

Using a=δx/δt and substituting for $v_{FP}-v_{FB}$ in equation 9 gives, $$v_{RP} - v_{RB} - \frac{g}{a}(H_P - H_B) = -\Delta v_T \quad (10)$$

adding equations 8 and 10 and simplifying gives, $$v_{RP} = \tfrac{1}{2}\left[v_{RA} + v_{RB} + \frac{g}{a}(H_A - H_B)\right] - \Delta v_T \quad (11)$$

substracting equation 8 and 10 and simplifying gives, $$H_p = \tfrac{1}{2}\left[H_A + H_B + \frac{a}{g}(v_{RA} - v_{RB})\right] \quad (12)$$

Using the absolute fluid and tube velocities, equation 11 may be written, $$v_{FP} = \tfrac{1}{2}\left[v_{FA} + v_{FB} + \frac{g}{a}(H_A - H_B)\right] \quad (13)$$

and equation 12 may be written, $$H_P = \tfrac{1}{2}\left[H_A + H_B + \frac{a}{g}(v_{FA} - v_{FB})\right] + \frac{a}{2g}(v_{TB} - v_{TA}) \quad (14)$$

It will be noted that the velocity of the tube at stations A and B along the tube, i.e. $v_{TA}$ and $v_{TB}$, only affects the fluid pressure $H_P$ and even then there is only an effect if $v_{TB}$ is different from $v_{TA}$.

This effect is stated as follows.

The pressure of a fluid enclosed in a tube may be affected by moving the tube so that, at the same instant of time, the velocity of the tube is different for different points along the length of the tube.

The velocity of a tube, at any instant, may be changed along the length of the tube without changing the tube length by bending the tube, i.e. changing the radius of curvature of the tube.

Knowing the initial conditions of velocity and pressure at various points along the tube and knowing the acceleration of the tube at these points ($\Delta v_T$) the fluid velocity and pressure at any subsequent time may be calculated using equation 11 and 12 in conjunction with appropriate well known equations for the conditions at the end positions of the tube. These latter equations depend on whether or not the end is open, closed or restricted.

It will be noted from equation 11 and 12 that if a tube begins to move when pressure and velocity are everywhere zero and every point on the tube has the same velocity such that the relative velocity of fluid to tube is everywhere constant then the initial fluid pressures and velocities will be undisturbed.

Pressures and velocities may be generated by closing a moving end of the tube—in which case the relative velocity of the contained fluid at this closed end is zero whereas it may vary elsewhere.

Pressures and velocities may be generated by changing the velocity of the tube along its length. Thus even when the fluid has an absolute velocity of zero. $v_{RA}$ may be different from $v_{RB}$ and it will be noted from equation 12 this change in velocity of the tube contributes to the pressure in the fluid.

This change in the velocity of the tube along its length is not accompanied by a change in length of the tube. It will be noted from the foregoing equation II that the length δx of tube was treated as independent of time. The change in the velocity of the tube along its length is caused by bending the tube, i.e, changing the radius of curvature of the tube with time.

Figure 8:
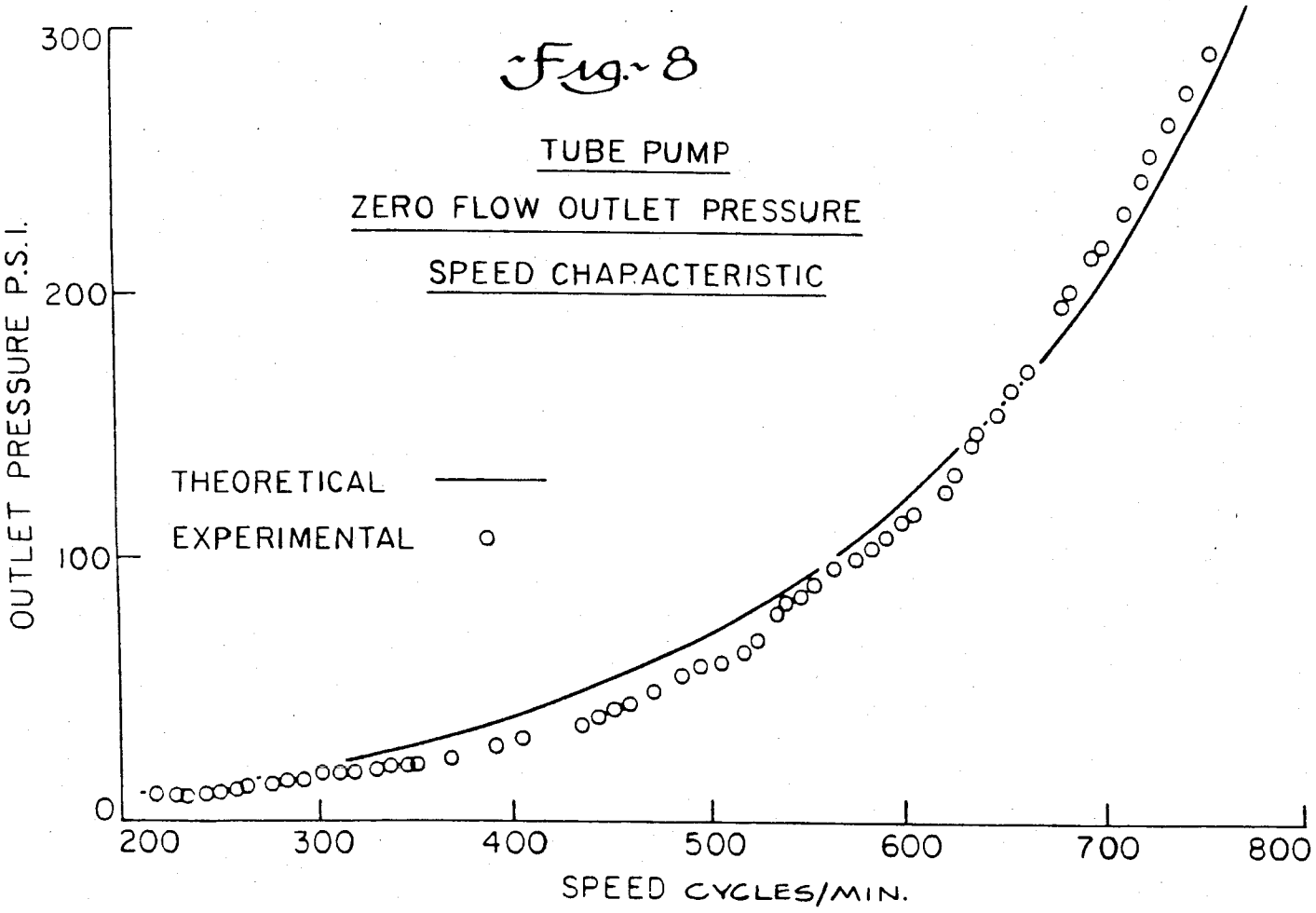
FIG. 8 is a graph illustrating pressure-speed characteristics.
Figure 9:
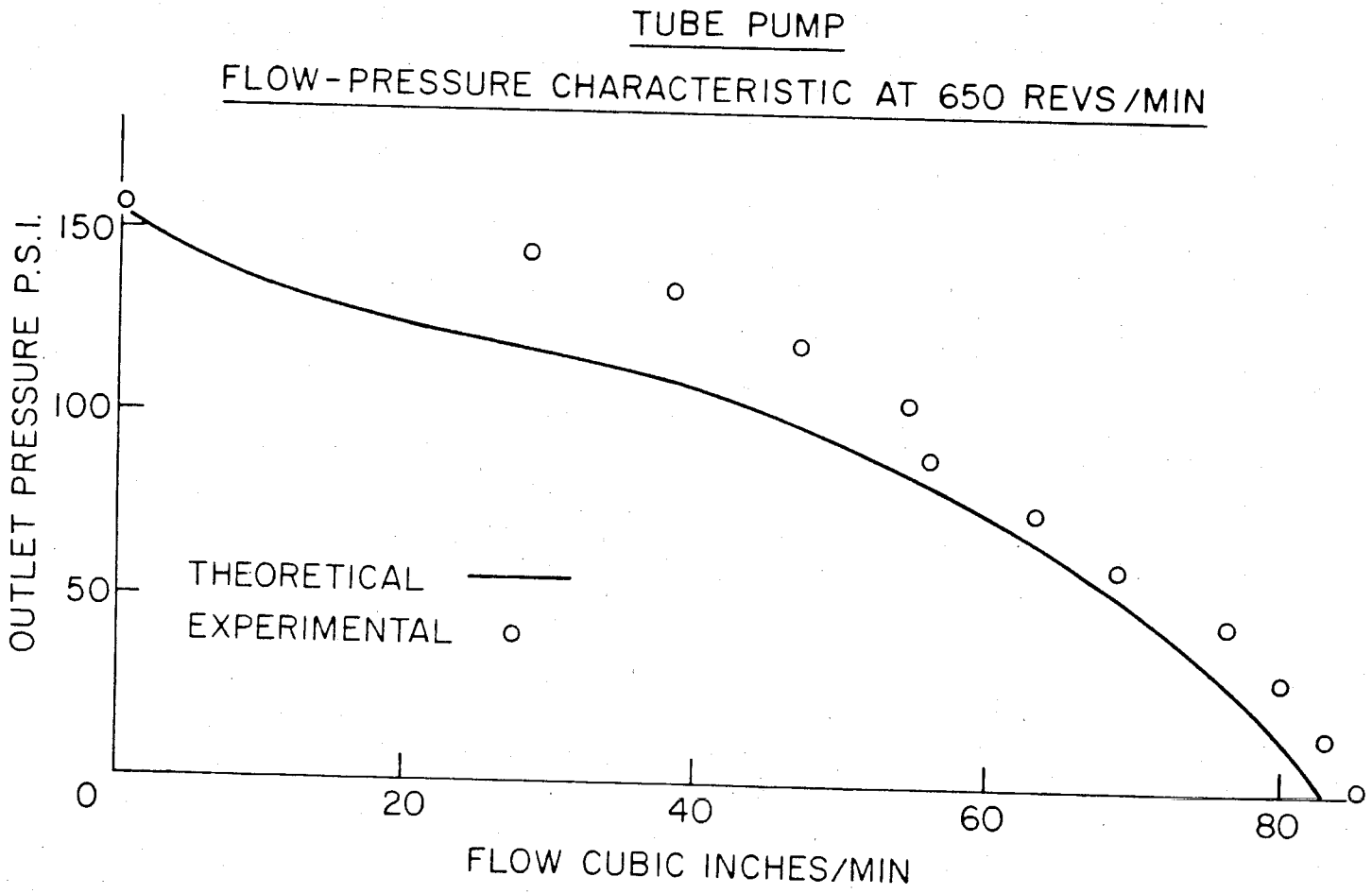
FIG. 9 is a graph illustrating flow-pressure characteristics.
Figure 10:
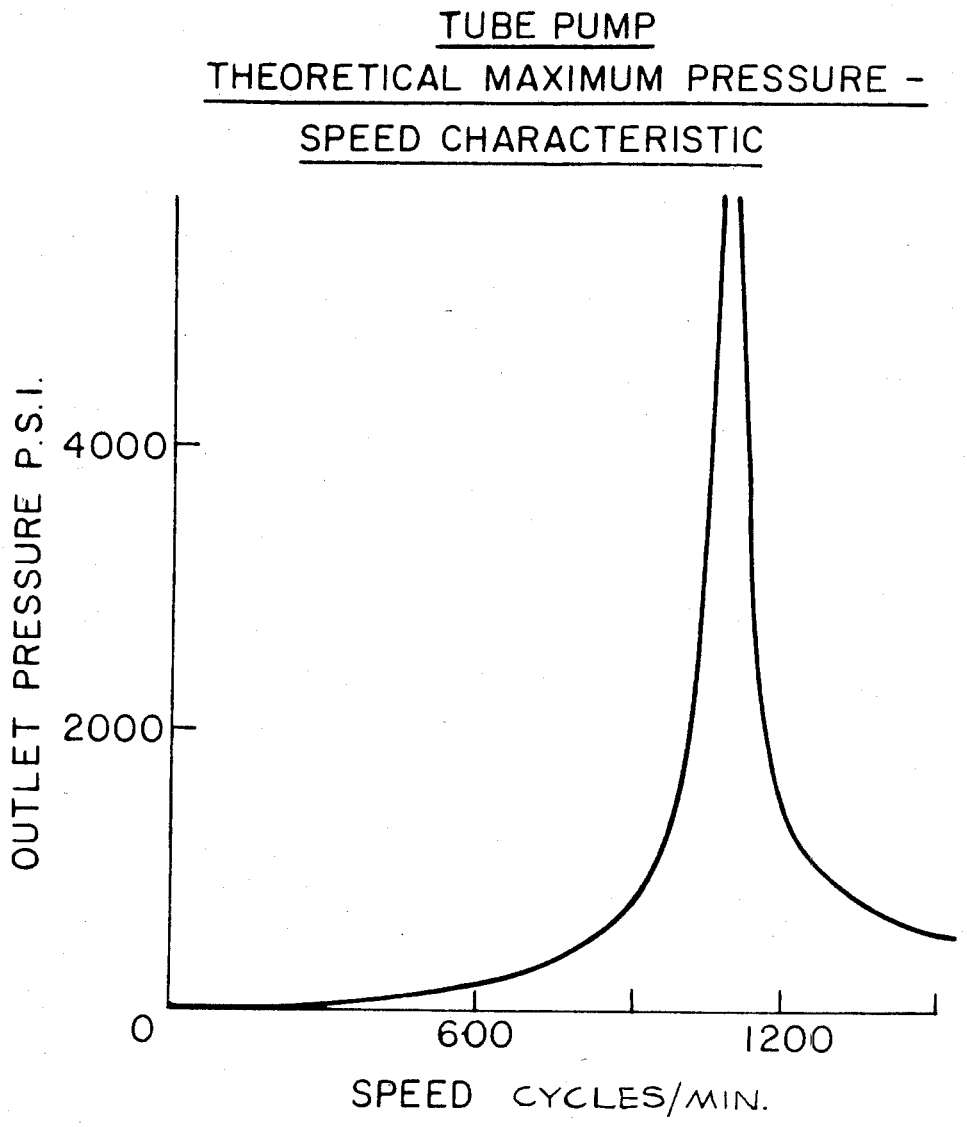
FIG. 10 is a graph illustrating theoretical maximum pressure vs speed characteristics.

FIG. 8 and 9 are graphs showing in each theoretical results using the foregoing theory and experimental results obtained with an actual device constructed in the form illustrated in FIG. 1. FIG. 10 is a graph illustrating maximum theoretical pressure vs. speed.

A device constructed as illustrated in FIG. 1 was used to pump water from an open tank having a water level 2.5 feet above the inlet check valve.

The tube pump consisted of 126 feet 9 inches of 0.5 inch outside diameter, 0.43 inch inside diameter steel tube wound into a 44 turn helix of 11 inch mean diameter.

The centre 40 turns of the helix were clamped to a drum for oscillation about the helix axis and the ends of the tube were clamped to a stationary frame. Two turns at each end of the helix were permitted to flex about the helix axis as the centre turns were oscillated. The tube coil or helix was mounted vertically with an inlet check valve connecting the lower end to a water supply and an outlet check valve connecting the upper end through a loading valve and pressure gauge to a metering tank.

The drum to which the central turns of the helical coil were attached was oscillated by means of a connecting rod arrangement so that the total axial displacement of the tube attached to the drum was 0.34 (3.5°). This axial tube movement reduced over the two deformable coils at each end of the helix to zero at the stationary clamp position An outlet pressure of 1650 P.S.I. was attained at an oscillation speed of 980 revs./min.

According to the foregoing theory and as illustrated graphically in FIG. 10, pressure in excess of 6,000 P.S.I. can be expected and that maximum pressure occurs at a specific rate of oscillation.

I claim:

1. An apparatus comprising:

(a) a supporting structure;

(b) a tube of selected length adapted for connection in fluid flow communication with an external fluid system and having respectively first and second opposite ends, at least a portion of said selected length of tube being coiled into the form of an open helix wound radially symmetrically about the axis of the helix and extending longitudinally along the axis of such helix, the wall of such tube being sufficiently rigid such that the tube does not expand radially during normal operating pressures of a fluid contained in the tube;

(c) means retaining said helical portion on said supporting structure such that the axis of the helix remains in essentially a fixed position relative to the supporting structure;

(d) means fixedly anchoring the helical portion, at a first position thereon to a rigid supporting structure preventing movement thereof at such position about the axis of the helix, said helical portion at a second position spaced from said first position axially along the helix being movable in an arc about the axis of the helix; and (e) means positively to move said helical portion at said second position a preselected equal amount in an arc in each of opposite directions about the axis of the helix alternately to increase and decrease the radius of curvature of the helical portion between said first and second positions whereby in each of the opposite directions there results a progressive change in axial tube velocity along the helical portion of the tube from one to the other of said first and second positions.

2. An apparatus as defined in claim 1 including first and second fluid flow restrictors in said tube respectively at opposite ends of said helical portion.

3. An apparatus as defined in claim 2 wherein the length of fluid flow path through the tube from one said flow restrictor to the other is co-related to a fluid wave propagated along the tube with the velocity of sound in the fluid relative to the fluid.

4. An apparatus as defined in claim 3 wherein said tube length is equal to one-half of the enclosed fluid wavelength or some integral number thereof.

5. An apparatus as defined in claim 1 wherein the length of tube between said first and second positions is no longer than one-quarter of the enclosed fluid wavelength.

6. An apparatus as defined in claim 1 wherein said means for moving the tube at said second position includes a shaft journalled on the supporting structure for oscillatory movement about an axis co-incidental with the axis of the helix and means securing said helical portion of said tube at said second position to said shaft for movement therewith.

7. An apparatus as defined in claim 6 wherein said helically coiled tube is a cylindrical helix and continues beyond said second position to a third position and wherein the tube from said second to said third position is rigidly secured to said shaft for movement therewith.

8. An apparatus as defined in claim 7 wherein said helically coiled tube continues beyond said third position to a fourth position and wherein said tube, at said fourth position, is fixedly secured to said supporting structure.

9. An apparatus as defined in claim 8 including first and second fluid flow restrictor means comprising one-way flow check valves adjacent respectively said first and fourth positions permitting fluid flow through the tube in one direction and resisting flow in a direction opposite said one direction.

10. An apparatus as defined in claim 9 wherein the length of fluid flow path through the tube from one said flow restrictor to the other is co-related to a fluid wave propagated along the tube with the velocity of sound in the fluid relative to the fluid.

11. An apparatus as defined in claim 10 wherein said tube length is equal to one-half of the enclosed fluid wavelength or some integral number thereof.

12. An apparatus comprising:

(a) a supporting structure;

(b) a tube having respective first and second opposite ends and sufficiently rigid so as not to expand radially during normal operating pressure of a fluid in the tube, at least a major portion of the length of said tube being in the form of an open cylindrical helix providing first and second contiguous helical coil portions on a common axis and each consisting of a selected length of said tube;

(c) means associated with said supporting structure and said first helical portion alternately torsionally twisting such helical portion in each of opposite directions a preselected limited amount about the axis of the helix, said torsional twisting progressively increasing and decreasing the radius of curvature of the tube in such helical portion from one end to the other thereof whereby there results a progressive change in axial tube velocity; and (d) means associated with said second helical portion and said frame preventing bending of the tube in said second helical portion.

13. An apparatus as defined in claim 12 including shaft means mounted on said supporting structure for preselected limited oscillatory movement about said common axis and wherein the selected length of tube of said second helical portion is securely mounted on said shaft means for movement therewith.

14. An apparatus as defined in claim 12 including means mounted on said supporting structure for limited oscillatory movement about said common axis, means rigidly securing said second helical portion of said tube to said supporting structure and means attaching the tube of said first helical portion to said oscillatory means at a position remote from said second helical portion.

15. An apparatus as defined in claim 12 including a third helical portion on said common axis contiguous with said second helical portion and including means torsionally to twist said third helical portion in timed relation with said first helical portion.

16. An apparatus as defined in claim 15 including a one-way flow control valve in said tube adjacent each said first and second opposite ends, means securely anchoring said first and second opposite ends of said tube to said supporting structure and wherein the length of the fluid flow path through the tube from one valve to the other is within the range of 75 to 100% of one-half of the length of a fluid wave propagated along the tube with the velocity of sound in the fluid relative to the fluid.

17. An apparatus as defined in claim 16 wherein said first and second opposite ends of said tube are fixedly secured to said supporting structure and wherein said second helical portion is mounted on a shaft journalled to oscillate about an axis co-incident with said common axis.

18. An apparatus as defined in claim 16 wherein said opposite ends of said tube are connected to shaft means journalled to oscillate about an axis co-incident with said common axis and wherein said second helical portion is fixedly anchored at opposite ends thereof to said supporting structure.

* * * * *